US009273644B2

(12) United States Patent
Kulesza

(10) Patent No.: US 9,273,644 B2
(45) **Date of Patent: *Mar. 1, 2016**

(54) IONIZATION BY MAGNETIC INDUCTION FOR DIESEL FUELED ENGINES

(71) Applicant: Roman Kulesza, Woodbridge (CA)

(72) Inventor: Roman Kulesza, Woodbridge (CA)

( * ) Notice: Subject to any disclaimer, the term of this patent is extended or adjusted under 35 U.S.C. 154(b) by 336 days.

This patent is subject to a terminal disclaimer.

(21) Appl. No.: 13/905,416

(22) Filed: May 30, 2013

(65) Prior Publication Data

US 2013/0327304 A1 Dec. 12, 2013

Related U.S. Application Data

(60) Provisional application No. 61/656,576, filed on Jun. 7, 2012.

(51) Int. Cl.
*F02M 27/04* (2006.01)

(52) U.S. Cl.
CPC ..... *F02M 27/045* (2013.01)

(58) Field of Classification Search
CPC ..... F02M 27/045
See application file for complete search history.

(56) References Cited

U.S. PATENT DOCUMENTS

| | | | | |
|---|---|---|---|---|
| 4,188,296 | A | 2/1980 | Fujita | |
| 4,716,024 | A | 12/1987 | Pera | |
| 4,933,151 | A | 6/1990 | Song | |
| 5,124,045 | A | 6/1992 | Janczak et al. | |
| 5,329,911 | A | 7/1994 | Jeong | |
| 5,331,807 | A | 7/1994 | Hricak | |
| 5,348,050 | A * | 9/1994 | Ashton | 137/827 |
| 5,500,121 | A * | 3/1996 | Thornton et al. | 210/222 |
| 5,664,546 | A | 9/1997 | De La Torre Barreiro | |
| 5,671,719 | A | 9/1997 | Jeong | |
| 5,829,420 | A | 11/1998 | Kita et al. | |
| 5,882,514 | A | 3/1999 | Fletcher | |
| 6,183,700 | B1 | 2/2001 | Jeong | |
| 6,405,719 | B2 | 6/2002 | Nozato | |
| 2014/0055222 | A1 * | 2/2014 | Kulesza | 335/219 |

* cited by examiner

*Primary Examiner* — David A Reifsnyder

(74) *Attorney, Agent, or Firm* — Buckingham, Doolittle & Burroughs, LLC

(57) ABSTRACT

A magnetic ionization device is disclosed that reduces the toxic effects of diesel emissions. The magnetic ionization device comprises a pair of brackets secured together around a fuel line, and at least two permanent rare earth magnets secured to the pair of brackets. The pair of brackets each comprises an interior surface and an exterior surface, and are generally V-grooved in shape. Furthermore, the brackets comprise a recess for receiving a portion of a fuel line. Once the permanent rare earth magnets are secured to the brackets, the brackets and magnets can be coated with plastic, powder metal, or any other suitable protective layer as is known in the art. The pair of brackets is then secured together around a fuel line via plastic ties, nuts, bolts, and/or washers, etc.

11 Claims, 5 Drawing Sheets

IONIZATION BY MAGNETIC INDUCTION FOR DIESEL FUELED ENGINES

CROSS-REFERENCE

This application claims priority from Provisional Patent Application Ser. No. 61/656,576 filed Jun. 7, 2012.

BACKGROUND

Without complete combustion, emissions are a form of wasted fuel. These emissions are released into the environment in the form of smog and other toxic substances. Medical scientists now confirm that diesel engine emissions are associated with lung cancer for non-smokers, potential organ failures, as well as other ailments and harmful side effects. Furthermore, these dangerous side effects increase the health care costs for both the engine operators and the employer's compensation liability. Additionally, without complete combustion, diesel engine emissions can result in engine downtime for maintenance by increasing engine wear, lost profits and increased operational costs, among other things. Further, prior art systems used electrostatic, electro-mechanical, invasive and weaker magnets to magnetize gasoline or diesel fuel. These prior art systems tend to not work as efficiently, or may feature fuel and air magnetic conditioning of opposite poles. Thus, a system for reducing harmful emissions while increasing operational efficiency is necessary.

The present invention reduces harmful emissions to human health in the environment while reducing the carbon footprint caused by incomplete combustion. The magnetic ionization device of the present invention when used with diesel engines provides better combustion, and reduces the potential health care costs for the engine operators and drivers as well as the employer's compensation liability. For example, field tests showed that smoke opacity for a truck's diesel engine was reduced by 66% within one hour of installation of the device at a government approved facility. Additionally, EPA approved equipment showed lower smoke opacity numbers for other diesel engines in tractors, box trucks and a coach bus when this device was installed.

Furthermore, this device uses permanent rare earth magnets, designed with physics, chemistry, and current metallurgical market availability of Lanthanide series with atomic numbers 57 to 71 in the periodic table, commonly known as the rare earth elements. Cobalt and/or Boron may also be included in the mix. The advantage of rare earth compounds over other magnets is that their crystalline structures have magnetic anisotropy. This means that a crystal of the material is very easy to magnetize in one particular direction, but resists being magnetized in any other direction. Additionally, it retains high magnetic moments in the solid state. The magnetization is also done during the heat treating process.

Furthermore, the magnetic ionization device is non-invasive and is installed around the exterior of a diesel fuel line prior to the point where the diesel fuel enters the combustion chamber. This device reduces the toxic effects of diesel emissions while increasing overall performance efficiency by attracting and aligning hydrocarbons, polarizing or charging fuel molecules so that the fuel breaks apart, disrupting molecular clusters of fuel, ionizing fuel, improving fuel burn through magnetic resonance, and lowering surface tension of the fuel, etc. Further, using this device to reduce emissions can increase profits and reduce operating costs by decreasing maintenance downtime and engine wear. Anyone who regularly uses a diesel engine may appreciate the benefits afforded by this device.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a magnetic ionization device that reduces the toxic effects of diesel emissions. The magnetic ionization device comprises a pair of brackets secured together around a fuel line, and at least one permanent rare earth magnet secured to the pair of brackets. The pair of brackets each comprises an interior surface and an exterior surface, and are generally V-grooved in shape. Furthermore, the brackets comprise a recess for receiving a portion of a fuel line. Once the permanent rare earth magnets are secured to the brackets, the brackets and magnets can be coated with plastic, powder metal, or any other suitable protective layer as is known in the art, that protects the magnets from harsh environments. The pair of brackets is then secured together around a fuel line via plastic ties, nuts, bolts, and/or washers, etc.

In a preferred embodiment, the brackets comprise recesses of different sizes, which allow the brackets to enclose fuel lines of different diameters. The brackets can then be positioned on either side of a fuel line such that the interior surface of the brackets contact each other, enclosing the fuel line, with larger brackets being used for fuel lines of larger diameter and smaller brackets being used for fuel lines of smaller diameter. Further, the pair of brackets is typically secured together around the fuel line prior to where the fuel line connects to the combustion chamber.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
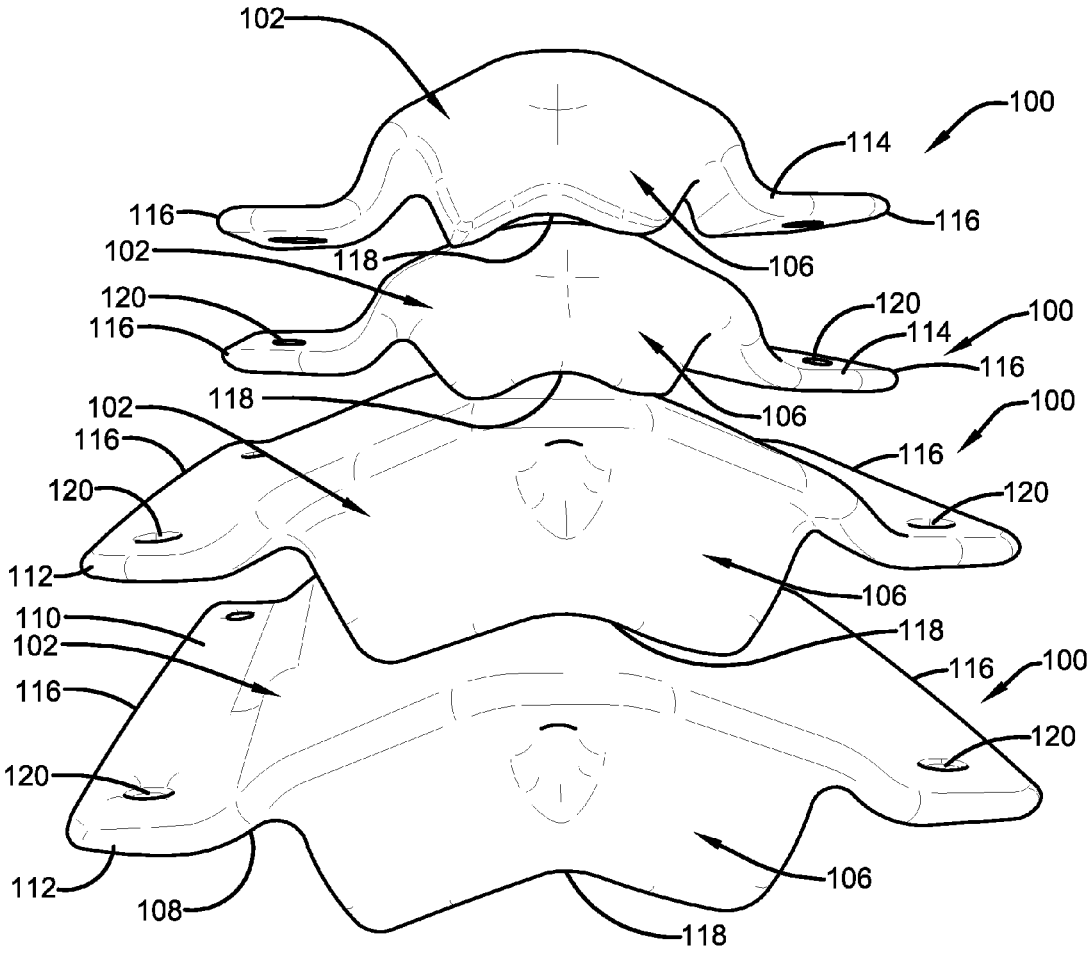
FIG. 1 illustrates a front perspective view of various sizes of the magnetic ionization device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a magnetic ionization device that reduces harmful emissions to human health in the environment while reducing the carbon footprint, and providing better combustion. This device uses permanent rare earth magnets, and is non-invasive, and is installed around the exterior of a diesel fuel line before the combustion chamber. This device reduces the toxic effects of diesel emissions while increasing overall performance efficiency. This device uses permanent rare earth magnets, designed with physics, chemistry, and current metallurgical market availability of Lanthanide series with atomic numbers 57 to 71 in the periodic table, commonly known as the rare earth elements. Cobalt and/or Boron may also be included in the mix. The advantage of rare earth compounds over other magnets is that their crystalline structures have magnetic anisotropy. This means that a crystal of the material is very easy to magnetize in one particular direction, but resists being magnetized in any other direction. Additionally, it retains high magnetic moments in the solid state. The magnetization is also done during the heat treating process. Further, using this device to reduce emissions can increase profits and reduce operating costs by decreasing maintenance downtime and engine wear. Anyone who regularly uses a diesel engine may appreciate the benefits afforded by this device.

The disclosed magnetic ionization device comprises a pair of brackets secured together around a fuel line, and at least two permanent rare earth magnets secured to the pair of brackets. The pair of brackets each comprises an interior surface and an exterior surface, and are generally V-grooved in shape. Furthermore, the brackets comprise a recess for receiving a portion of a fuel line. Once the permanent rare earth magnets are secured to the brackets, the brackets and magnets can be coated with plastic, powder metal, or any other suitable protective layer as is known in the art. The pair of brackets is then secured together around a fuel line via plastic ties, nuts, bolts, and/or washers, etc.

Figure 2:
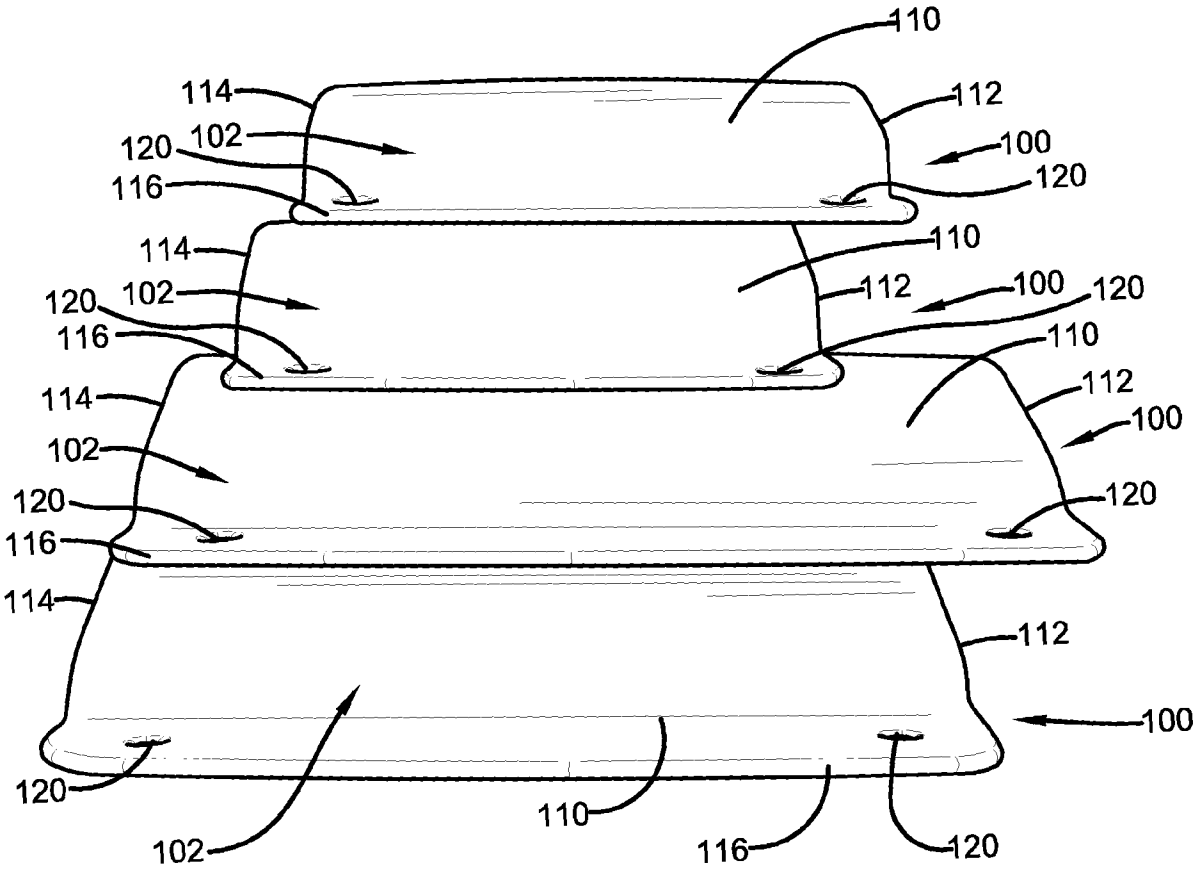
FIG. 2 illustrates a side perspective view of various sizes of the magnetic ionization device in accordance with the disclosed architecture.

Referring initially to the drawings, FIGS. 1-2 illustrate the magnetic ionization device 100 that reduces the toxic effects of diesel emissions while increasing overall performance of fuel lines. The magnetic ionization device 100 comprises a pair of brackets 102 secured together around a fuel line 104, and at least two permanent rare earth magnets 106 secured to the pair of brackets 102 (as shown in FIG. 1).

The pair of brackets 102 each comprises an interior surface 108 and an exterior surface 110. Typically, each of the brackets 102 are V-grooved, C-shaped, or crescent shaped, however any other suitable shape can be used as is known in the art without affecting the overall concept of the invention. The brackets 102 would generally be constructed of steel, iron, etc., though any other suitable ferrous material may be used to manufacture the brackets 102 as is known in the art without affecting the overall concept of the invention.

The brackets 102 can also comprise a variety of colors and designs to suit user and manufacturing preference, and can be manufactured in a variety of sizes depending on the wants and needs of a user (as shown in FIGS. 1 and 2). The brackets 102 are approximately between 3 and 5 inches long as measured from a first end 112 to a second end 114, approximately between 3⅛ and 4 inches wide as measured from opposing sides 116, and approximately between ½ and ¾ inches thick, as measured from the interior surface 108 to the exterior surface 110 at its farthest opposing point.

Figure 3:
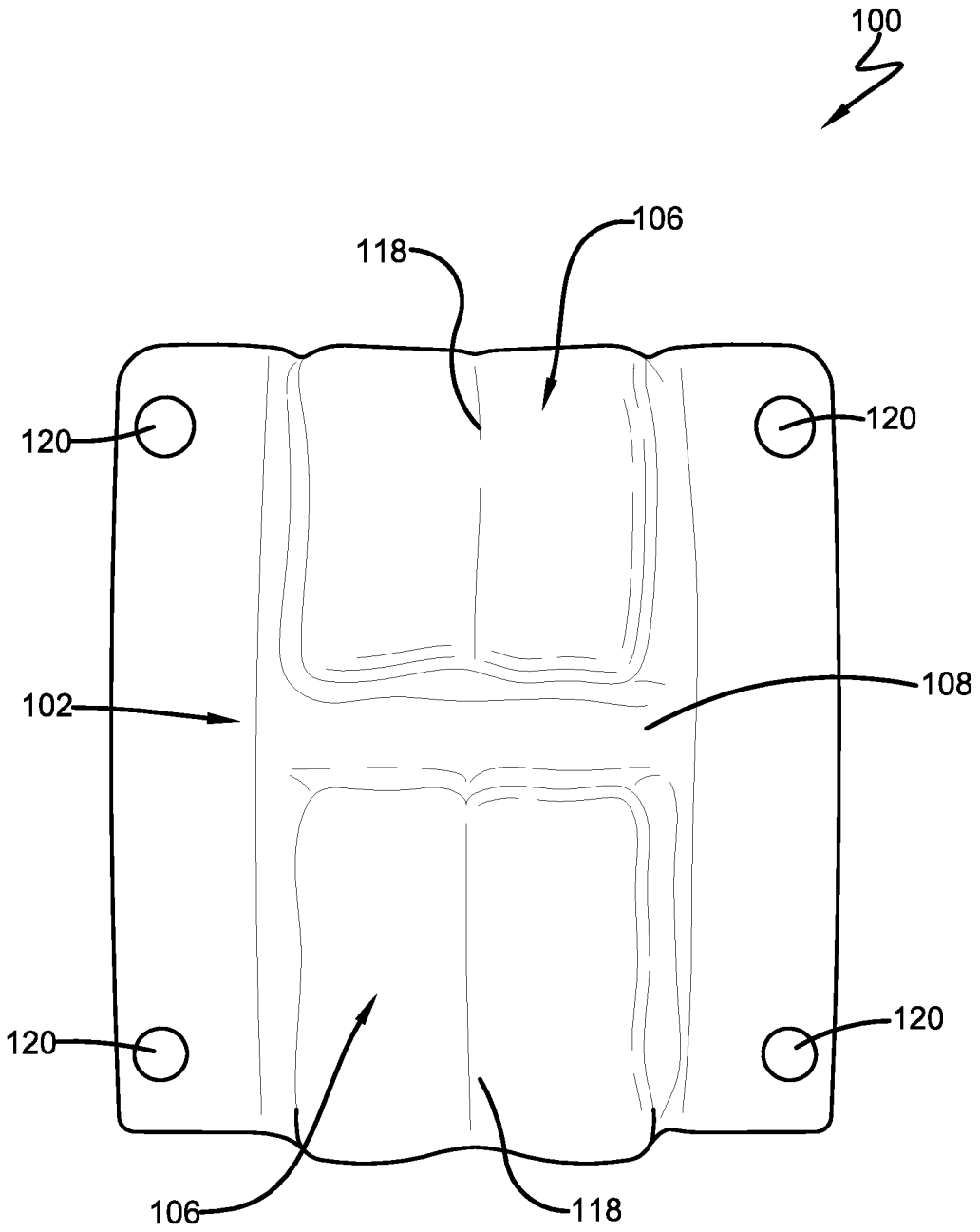
FIG. 3 illustrates a bottom perspective view of a magnetic ionization device with a larger diameter in accordance with the disclosed architecture.
Figure 4:
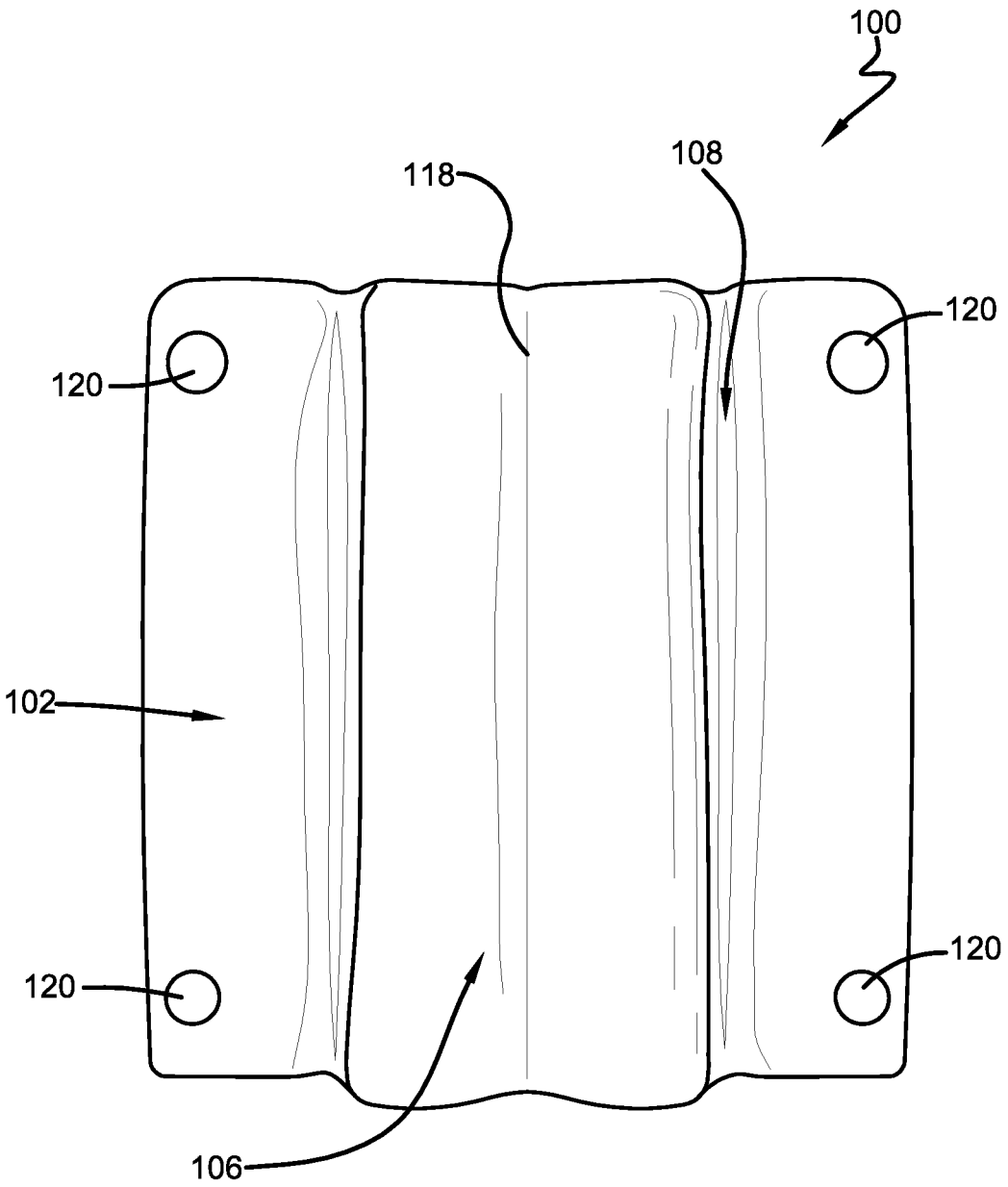
FIG. 4 illustrates a bottom perspective view of a magnetic ionization device with a smaller diameter in accordance with the disclosed architecture.
Figure 5:
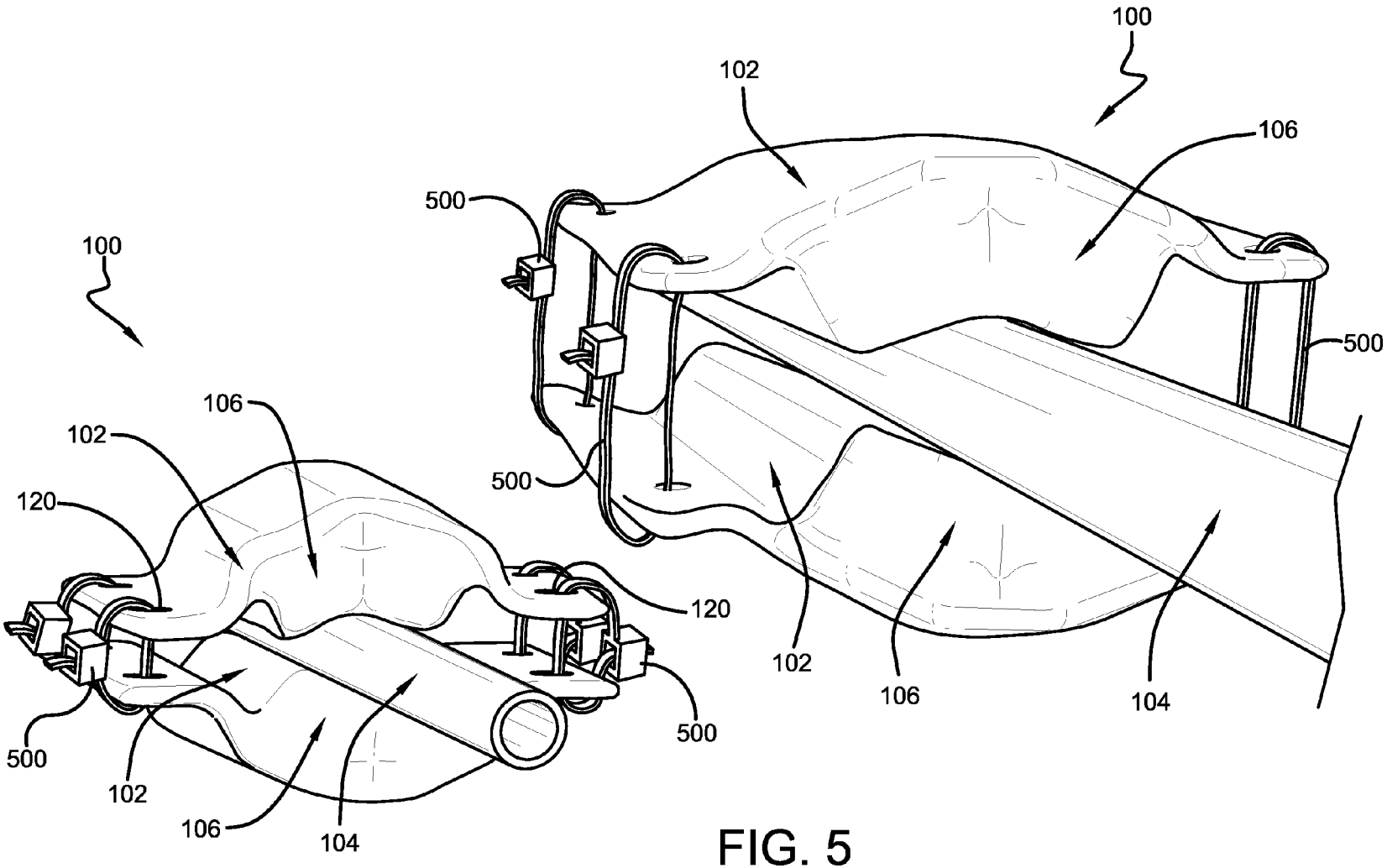
FIG. 5 illustrates a perspective view of a magnetic ionization device in use in accordance with the disclosed architecture.

Typically, the brackets 102 are used in pairs, but they do not have to be and the device 100 can function with only one bracket 102, although the device 100 performs more efficiently with a pair of brackets 102 (as shown in FIG. 5). Furthermore, the brackets 102 comprise a recess 118 for receiving a portion of a fuel line 104. The brackets 102 can comprise recesses 118 of different sizes, which allow the brackets 102 to enclose fuel lines 104 of different diameters. For example, FIG. 3 illustrates brackets 102 for enclosing larger diameters of fuel lines 104, and FIG. 4 illustrates brackets 102 for enclosing smaller diameters of fuel lines 104. Further, only one bracket 102 can be used with a metal back plate (not shown) if space considerations limit the installation.

The magnetic ionization device 100 further comprises at least two permanent rare earth magnets 106 secured to the pair of brackets 102. In a preferred embodiment, there are a plurality permanent earth magnets 106 secured to the pair of brackets 102, however any suitable number of permanent earth magnets 106 can be used with the magnetic ionization device 100 as is known in the art without affecting the overall concept of the invention. The permanent rare earth magnets 106 are typically secured to the interior surface 108 of each bracket 102 via magnetic attraction. However, the permanent rare earth magnets 106 can be secured to any suitable position on the interior surface 108 of the brackets 102. The permanent rare earth magnets 106 can also be secured to the brackets 102 via any suitable securing means as is known in the art.

The permanent rare earth magnets 106 are designed with physics, chemistry, and metallurgy, such that during the heat treating process the magnetizing of the rare earth metal is introduced. Typically, only the south exiting pole of the magnets 106 is used for proper application facing the fuel line. The south pole is defined by the north needle of a compass being attracted to the south pole. North pole of the magnets 106 attaches to the inside of the metal bracket 102. Neodymium magnets have been replacing ALNICO (Aluminum, Nickel, and Cobalt) and Ferrite in many applications. Modern technology requires powerful magnets. The greater strength of the magnets 106 allows for smaller, lighter magnets to be used for this application which also depends on market availability of Cobalt, Boron and Lanthanides.

In a preferred embodiment, the permanent rare earth magnets 106 comprise Neodymium Iron Boron (NdFeB), Iron-Boron, and/or Samarium Cobalt (SmCo), ($Nd_2Fe_{14}B$), and ($SmCo_5$), though any other suitable magnets can be used as is known in the art without affecting the overall concept of the invention. The advantage of rare earth metals, is that the rare earth metals will not lose or diminish magnetic flux strength from small motor vibrations or of an accidental shock or blow by a hard object.

Once the permanent rare earth magnets 106 are secured to the brackets 102, the brackets 102 and magnets 106 can be coated with a protective layer to protect the magnets 106 from corrosion and the metal brackets 102 from rusting. The brackets 102 and magnets 106 can be coated in plastic, powder metal, or any other suitable protective layer as is known in the art.

A pair of brackets 102 is then secured together around a fuel line 104. Typically, the pair of brackets 102 is secured together via plastic ties 500, nuts, bolts, and/or washers, etc., or any other suitable securing means as is known in the art. Specifically, the pair of brackets 102 are positioned on either side of a fuel line 104 such that the interior surface 108 of the brackets 102 contact each other, enclosing the fuel line 104. Further, openings (or holes) 120 on the edges of the brackets 102 are aligned and plastic ties 500 or nuts, bolts, and washers (not shown) are threaded through the openings 120 and fastened, securing the pair of brackets 102 together.

Further, the pair of brackets 102 are secured together around the fuel line 104 before a combustion chamber (not shown), or at any other suitable position on a fuel line 104. In a preferred embodiment, the brackets 102 are secured together around the fuel line 104 before the combustion chamber so that the magnetic effects are better realized before it reaches the combustion chamber. Depending on cold weather, which may cause waxing of the fuel, another magnet 106 could be installed on the fuel line 104 which exits the fuel tank.

Typically, the fuel line 104 is a fuel injection line or a fuel rail line, or any other suitable fuel line for diesel fuel. The diesel fuel that flows through the fuel line 104 can be any of the following six grades, wherein the boiling point, carbon chain length, and viscosity of the fuel increases with the fuel oil number, such that the heaviest oil has to be heated to get it to flow. Number 1 fuel oil is a volatile distillate oil intended for vaporizing pot-type burners. Number 2 fuel oil is a distillate home heating oil, and a summer diesel fuel which is a number 2 engine grade. Number 3 fuel oil is a distillate oil for burners requiring low-viscosity fuel. Number 4 fuel oil is a commercial heating oil for burner installations not equipped with preheaters. Number 5 fuel oil is a residual-type industrial heating oil requiring preheating to 170-220° F. (77-104° C.) for proper atomization at the burners. This fuel is sometimes known as Bunker B. Number 6 fuel oil is a high-viscosity residual oil requiring preheating to 220-260° F. (104-127° C.). This fuel may be known as residual fuel oil (RFO), by the Navy specification of Bunker C. Thus, Numbers 5 and 6 require the fuel oil to be pre-heated before the magnetic ionization device 100 can be utilized.

Further, as stated supra, the brackets 102 can be different sizes to accommodate fuel lines 104 of different diameters (as shown in FIGS. 1 and 2). Thus, the different sizes of brackets 102 can accommodate diesel engine variations from 18-cylinder locomotive size, heavy haulers, bulldozers, off-road equipment, generators, marine engines, tractors, etc., or any other suitable machine as is known in the art. Further, each device 100 can be custom built for a user's need and/or desire.

Additionally, any suitable number of brackets 102 can be secured to a fuel line 104, although the brackets 102 are typically positioned in pairs. Generally, the more brackets 102 that are secured to the fuel line 104 and utilized cause an increase in efficiency, such that more toxins and impurities are exposed to a better combustion. Specifically, this device 100 reduces the toxic effects of diesel emissions while increasing overall performance efficiency by attracting and aligning hydrocarbons, polarizing or charging fuel molecules so that it breaks apart, disrupting molecular clusters of fuel, ionizing fuel, improving fuel burn through magnetic resonance, and lowering surface tension of the fuel, etc.

FIGS. 3-4 illustrate different size brackets 102 of the magnetic ionization device 100. For example, FIG. 3 illustrates brackets 102 for enclosing larger diameters of fuel lines 104, and FIG. 4 illustrates brackets 102 for enclosing smaller diameters of fuel lines 104. As stated supra, the brackets 102 comprise a recess 118 for enclosing a portion of a fuel line 104. The brackets 102 can comprise recesses 118 of different sizes, which allow the brackets 102 to enclose fuel lines 104 of different diameters. Thus, the different sizes of brackets 102 can accommodate diesel engine variations from 18-cylinder locomotive size, heavy haulers, bulldozers, off-road equipment, generators, marine engines, tractors, etc., or any other suitable machine as is known in the art. Further, each device 100 can be custom built for a user's need and/or desire.

FIG. 5 illustrates the magnetic ionization device 100 in use. In operation, a user (not shown) would choose the size and/or the amount of magnetic ionization devices 100 that meets their needs and/or wants. The user would then determine what type of fuel line 104 to secure the device 100 to. The user then positions the brackets 102 of the device 100 on either side of the fuel line 104, enclosing the fuel line 104. Specifically, the user positions the brackets 102 such that the interior surface 108 of the brackets 102 which contain the permanent rare earth magnets 106 contact each other, enclosing the fuel line 104. Typically, the user positions the brackets 102 before the combustion chamber on the fuel line 104.

Once positioned, the user then secures the brackets 102 together, via the use of plastic ties 500, nuts, bolts, and/or washers. Specifically, the user inserts the plastic ties 500 (or nuts, bolts, and/or washers) through the openings 120 of the brackets 102 and fastens them, securing the pair of brackets 102 together. The user then determines whether to apply more brackets 102 to the fuel line 104. The user can then position the additional brackets 102 in pairs along the fuel line 104, before the combustion chamber, and can secure the brackets 102 via the plastic ties 500, nuts, bolts, and/or washers. The user then utilizes the fuel line 104 per normal operation.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A magnetic ionization device comprising:

at least two permanent rare earth magnets comprised of Lanthanide series magnets with atomic numbers 57 to 71 in periodic table; and a pair of steel brackets attached to a fuel line;

wherein the pair of steel brackets comprise an interior surface, an exterior surface, and are V-grooved in shape, and comprise a recess for receiving a portion of the fuel line; and wherein the at least two permanent rare earth magnets are attached to the interior surface of the pair of brackets via magnetic attraction; and wherein only south poles of the at least two permanent rare earth magnets are applied facing the fuel line, and north poles of the at least two permanent rare earth magnets attach to the interior surface of the pair of steel brackets.

2. The device of claim 1, wherein the pair of brackets and the at least two permanent rare earth magnets are coated in plastic.

3. The device of claim 1, wherein the pair of brackets and the at least two permanent rare earth magnets are coated in powder metal.

4. The device of claim 1, wherein the pair of brackets are secured together around the fuel line via at least one of plastic ties, nuts, bolts, or washers.

5. The device of claim 1, wherein the bracket is secured to the fuel line before a combustion chamber.

6. The device of claim 5, wherein the fuel line is at least one of a fuel injection line or a fuel rail line.

7. A magnetic ionization device comprising:

a plurality of permanent rare earth magnets comprised of Lanthanide series magnets with atomic numbers 57 to 71 in periodic table; and a pair of steel brackets comprising an interior surface and an exterior surface, and are V-grooved in shape, and comprise a recess for receiving a portion of a fuel line; and wherein the plurality of permanent rare earth magnets are secured to the interior surface via magnetic attraction, and then the pair of brackets and the plurality of permanent rare earth magnets are coated in powder metal; and wherein the interior surface of the pair of brackets is then secured together around the fuel line; and wherein only south poles of the at least two permanent rare earth magnets are applied facing the fuel line, and north poles of the at least two permanent rare earth magnets attach to the interior surface of the pair of steel brackets.

8. The device of claim 7, wherein the pair of brackets are secured together via at least one of plastic ties, nuts, bolts, or washers.

9. The device of claim 7, wherein the pair of brackets are secured together around the fuel line before a combustion chamber.

10. The device of claim 9, wherein the fuel line is at least one of a fuel injection line or a fuel rail line.

11. A magnetic ionization device comprising:

a plurality of permanent rare earth magnets comprised of Lanthanide series magnets with atomic numbers 57 to 71 in periodic table; and a pair of steel brackets comprising an interior surface and an exterior surface, and are V-grooved in shape, and comprise a recess for receiving a portion of a fuel line; and wherein the plurality of permanent rare earth magnets are secured to the interior surface via magnetic attraction, and then the pair of brackets and the plurality of permanent rare earth magnets are coated in plastic; and wherein the interior surface of the pair of brackets is then secured together around a fuel line before a combustion chamber; and wherein only south poles of the at least two permanent rare earth magnets are applied facing the fuel line, and north poles of the at least two permanent rare earth magnets attach to the interior surface of the pair of steel brackets.

* * * * *